United States Patent [19]

Glantz

[11] 4,145,950

[45] Mar. 27, 1979

[54] WIND INSTRUMENT SUPPORTING STAND

[76] Inventor: Fred Glantz, 199-50 24 Rd., Whitestone, N.Y. 11357

[21] Appl. No.: 823,689

[22] Filed: Aug. 11, 1977

[51] Int. Cl.[2] ..... G10D 9/00; G10G 5/00

[52] U.S. Cl. ..... 84/385 R; 84/387

[58] Field of Search ..... 84/327, 380–387, 84/453; 211/13

[56] References Cited

U.S. PATENT DOCUMENTS

| | | | |
|---|---|---|---|
| 2,920,851 | 1/1960 | Carlini | 84/387 X |
| 3,203,298 | 8/1965 | Samrall | 84/453 |
| 4,036,462 | 7/1977 | Sheftel | 84/385 X |

*Primary Examiner*—Lawrence R. Franklin
*Attorney, Agent, or Firm*—Shlesinger, Arkwright, Garvey and Dinsmore

[57] ABSTRACT

A peg stand for wind musical instruments. The peg has a solid base, a supporting shaft and a button-shaped top. The instrument rests on the base and is held in a vertical position by the button-shaped top. The peg has a weakened point which will fail if the instrument is subjected to excessive force, thereby protecting the instrument from being damaged. The button-shaped top has specially tapered corners which facilitate placement on and removal from the stand of the instrument.

16 Claims, 8 Drawing Figures

WIND INSTRUMENT SUPPORTING STAND

FIELD OF INVENTION AND BACKGROUND

This invention relates to a musical instrument stand for supporting wind instruments in a vertical position when not in use. The invention provides a sure support which protects the instrument and facilitates placement on and removal from the stand of the instrument.

Friedman, in U.S. Pat. No. 3,637,070 discloses a combined carrying case and trumpet stand consisting of a truncated cone mounted on a stick which fits into the mouth of the trumpet. Carlini, in U.S. Pat. No. 2,920,851 discloses a cornet stand that consists of a base portion with a shape very close to that of the bell of the cornet. Above the base spring fingers grip the interior of the instrument mouth.

Smith, in U.S. Pat. No. 3,357,666 discloses a clarinet stand consisting of two metal rings mounted on a rod which engage the mouth of the instrument.

Cundy in U.S. Pat. No. 270,640, Lang in U.S. Pat. No. 1,900,718, and Sumrall in U.S. Pat. No. 3,203,298 disclose one piece conical clarinet stands.

FEATURES AND SUMMARY

An important feature of this invention is protection of the instrument from damage. This is particularly a problem when the instrument is inadvertantly kicked or bumped when mounted in a vertical position. Similarly, this invention, through the inventive use of materials, protects the instrument against excessive wear while insuring the durability of the stand itself.

Another feature of this invention is adaptability to instruments of different shapes and sizes. The same basic stand with a slight alteration can support a wind instrument with any mouth or bell size by changing the button on top. Another feature of this invention is easy placement and removal. The invention allows the instrument to rest on the stand without becoming locked or stuck on the stand.

Another feature of this invention is that it enables the user or users to store a number of instruments of different sizes on one stand.

This invention relates to a musical instrument stand for vertically supporting instruments of any size. The stand has a peg which is attached to a flat support. The peg has a conical base, a vertical shaft and an interchangable button mounted on top of the shaft. The end of the bell-shaped portion of the instrument rests on the conical base while the button and shaft extend into the mouth of the instrument. The interchangable button is designed to provide sufficiently close contact with the interior of the instrument to give it sure support. However, its corners are specially tapered, and its height is less than its diameter, to aid in the placement on and removal from the stand of the instrument. A special pointed button is used for very small instruments such as the piccolo. The stand is provided with a weakened point so that if the instrument is subjected to excessive force the stand will fail before the instrument is damaged.

DESCRIPTION OF THE INVENTION

Figure 1:
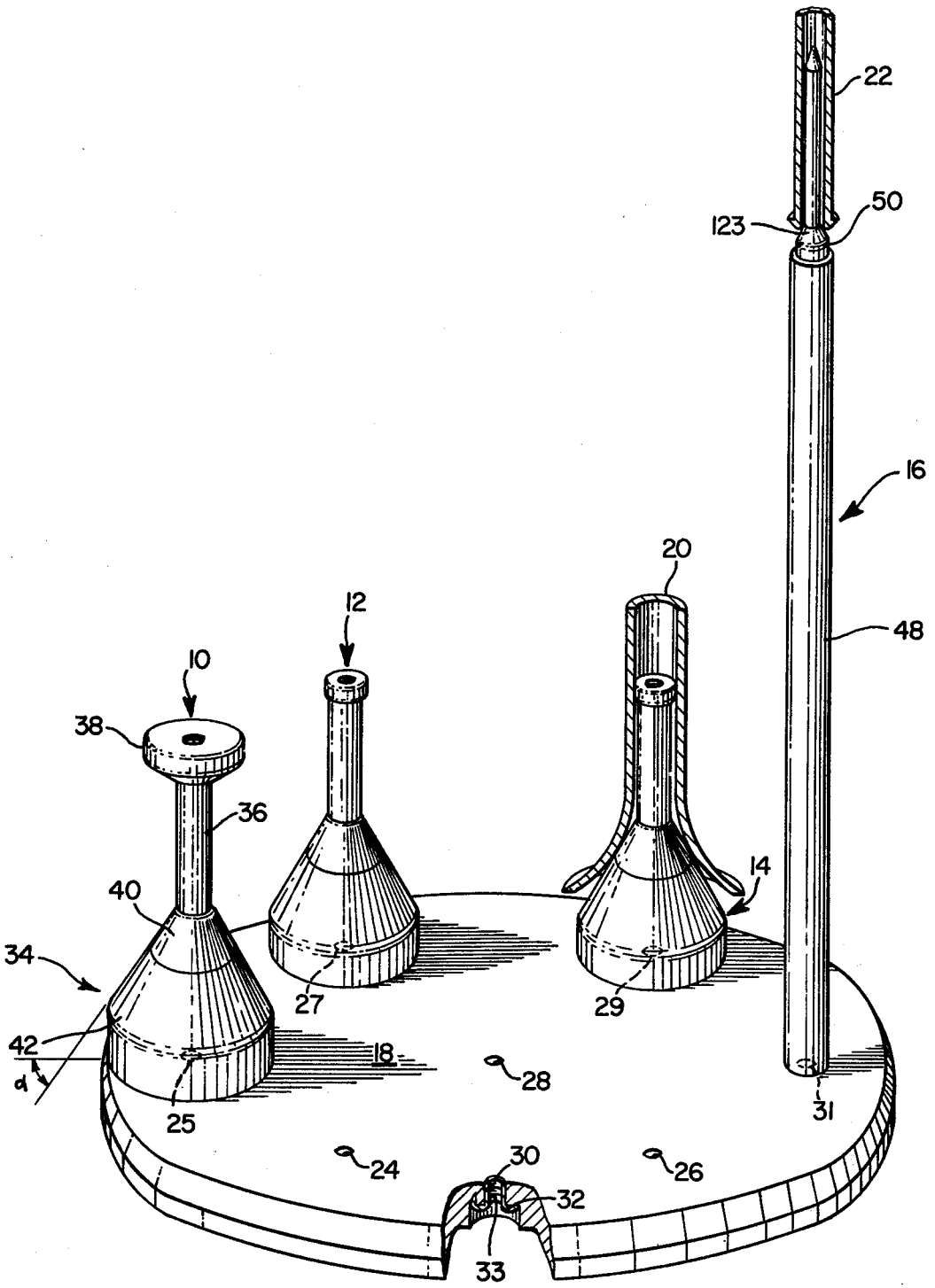
FIG. 1 is a perspective view of four pegs attached to a circular support.

A stand for vertically supporting wind musical instruments is shown in FIG. 1. For illustration purposes four different pegs 10, 12, 14 and 16, each capable of supporting one instrument, are shown attached to circular support 18. A wind instrument such as clarinet 20, (shown in part), is supported on peg 14 which is inserted into the open bell or mouth of the instrument. Each of the pegs shown in FIG. 1 can be adapted to receive an instrument of any size, peg 16 being particularly suitable as a support for piccolo 22 (shown in part). In FIG. 1, circular support 18, which can be made of wood such as chipboard, is of substantial mass to insure solid support for a plurality of instruments. The support 18 has eight threaded mounting holes 24, 25, 26, 27, 28, 29, 30 and 31 which receive bolts not shown mounted in the base of each peg 10, 12, 14 and 16. The circular support 18 has six of the threaded mounting holes circularly disposed around its periphery with hole 28 at the center thereof. The holes 25, 27, 29 and 31 are shown occupied by pegs 10, 12, 14 and 16 and holes 24 and 26 are unoccupied. The hole 28 is unoccupied and is located in the center of the support 18 and the hole 30 is shown between holes 24 and 26 but closer to the periphery of the circular support 18 and outside the circle of holes 24, 25, 26, 27, 29 and 31. This arrangement has been found most useful since a variety of musical instruments of widely varying sizes may be supported at any one time. The mounting holes have counterboring 32 as shown in the cutaway at hole 30 and each mounting hole has a threaded tee-nut nail 33 driven in from the bottom of circular support 18.

Refer now to peg 10 in FIG. 1 for purposes of illustration. The peg 10 has a two piece conical base 34, vertical dowel 36, and interchangable circular button 38.

The two piece conical base 34 is made of upper frustoconical portion 40 and lower frustoconical portion 42. In the preferred form the straight taper of the conical base represented by the alpha is approximately 55°. This linear taper means that the inner surface of the instrument will contact the frustoconical portion at some point, which point will serve to steady the instrument and keep its bottom bell or mouth from contact with base 18. The upper portion 40 is preferably made of a smooth hard wood such as oak which minimizes abrasion of the instrument which may contact it on placement on or removal from the stand. The lower portion 42 may be made of any suitable material such as chipboard.

Figure 3:
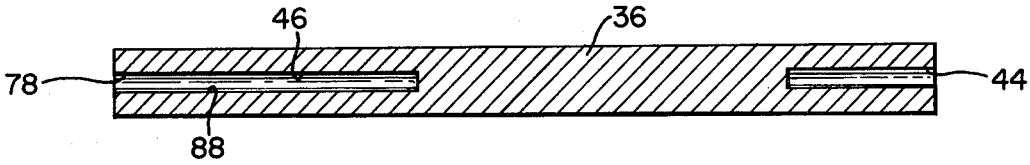

The center of the conical base 34 is bored out to receive the dowel 36 as shown in FIG. 3. The dowel has upper drilled-out portion 44 which contacts button 38 and lower drilled-out portion 46 which contacts conical base 34.

Figure 2:
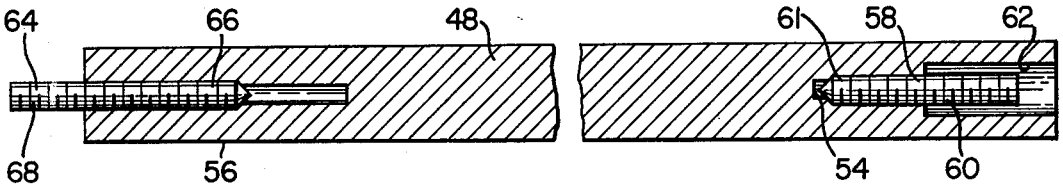
FIGS. 2 and 3 are cross-sections of the dowels used in this invention.

Refer now to piccolo peg 16 in FIG. 1 for purposes of illustration. The peg 16 has vertical shaft 48 and interchangable piccolo button 50. The vertical piccolo shaft 48 is also shown in FIG. 2. The shaft consists of upper drilled-out portion 54 and lower drilled-out portion 56. The upper drilled-out portion 54 is countersunk and double-threaded hangerbolt 58 is secured so that upper-threaded end 60 of the hangerbolt 58 extends into the countersunk region 62 of upper drilled-out portion 54 while lower-threaded end 61 threads into the shaft 48. Lower drilled-out portion 56 is similarly fitted with hangerbolt 64, the upper end 66 of which threads into the lower drilled-out portion 56 while the lower end 68 extends beyond the shaft 48. In its preferred form the shaft 48 is approximately one foot long. The shaft 48 serves to bring the small instrument closer to the user.

Figure 4:
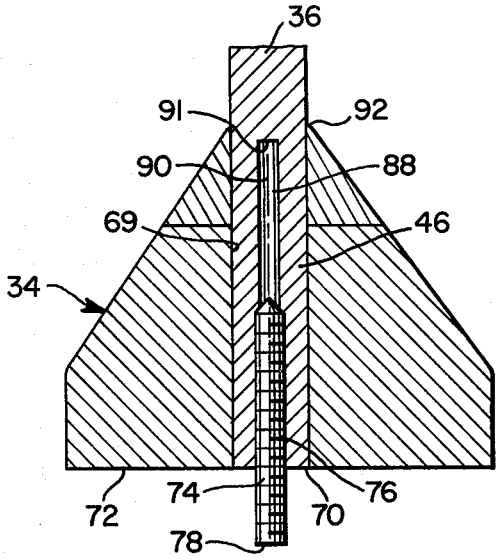
FIGS. 4 and 5 are cross-sections of two structures used to attach the peg to the circular support.
Figure 5:
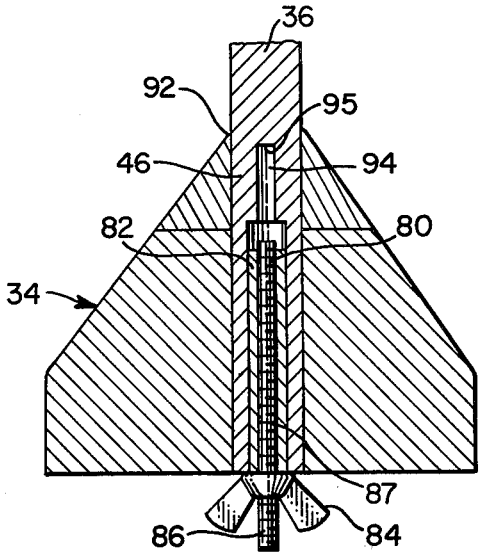

FIGS. 4 and 5 show two methods of connecting the dowel 36 to the conical base 34 and the circular support 18. In FIG. 4 dowel 36 is pressed into the central hole 69 in the conical base 34 so that the lower surface 70 of the dowel 36 is coplanar with the lower surface 72 of the conical base 34. Double-threaded hangerbolt 74 has upper-threaded section 76 and lower-threaded section 78. Upper section 76 is secured into lower drilled-out portion 46 of dowel 36. The lower-threaded section 78 is then screwed into a threaded mounting hole such as the hole 25 in circular support 18, shown in FIG. 1.

Alternatively, as shown in FIG. 5, hangerbolt 80, which may be of a diameter less than that of hangerbolt 74, can be threaded into dowel plug 82. Dowel plug 82, in turn, is driven into lower drilled-out portion 46 which may be widened to accomodate the plug 82. The peg is then connected to the circular support 18 in either of two ways. The peg may be connected to the support 18 using wing nut 84 which can be tightened onto the hangerbolt 80 lower section 86 from the underside of the support 18, the wing nut disappearing into a counterboard hole. In this way the peg 10 can be attached to any suitable support 18 regardless of the size of the threaded mounting holes in the support 18. Also the peg can be attached simply by putting the hangerbolt lower section 86 into a mounting hole in any type of support such as a saxophone stand not shown, and retaining it with the wing nut 84.

The hole 88 in the lower drilled-out portion 46 of dowel 36 shown in FIG. 4 extends into the dowel 36, a distance of about twice the length of the upper hangerbolt portion 76. This creates a hollow section 90 in the dowel 36 approximately in the region where the conical base consists of instrument contacting upper frustoconical portion 40. The highest point 91 of the hollow section 90 is approximately $\frac{1}{8}$" below the uppermost point 92 of the conical base 34. The hollow section 90 creates a shear point at which the peg rather than the instrument will break if the assembly is subjected to an excessive force. Similarly, in FIG. 5, it can be seen that the lower drilled-out portion 46 of the dowel 36 is much longer than the hangerbolt section 87. A hollow section 94 is left in the dowel 36. The highest point 95 of the hollow section 94 is approximately $\frac{1}{8}$" below the uppermost point 92 of the conical base 34. Again this creates a weakened zone which encourages failure of the stand at the point 95 rather than of the instrument if the assembly is subjected to an excessive force.

Figure 6:
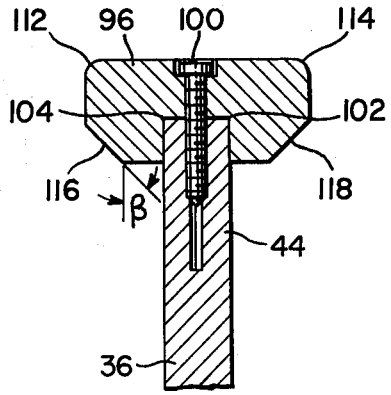
FIGS. 6, 7 and 8 are cross-sections of the buttons used in this invention and the structure used to attach the button to the dowel.
Figure 7:
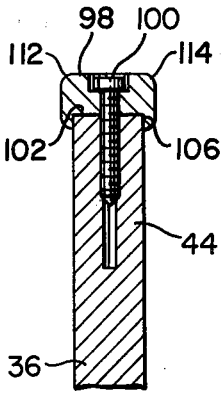

FIGS. 6 and 7 illustrate the preferred manner of attaching the interchangable button 96 or 98 to a dowel 36. A countersunk and counterbored hole is drilled centrally into the button and screw 100 is passed through the button 96 and threaded into upper drilled-out portion 44 of dowel 36. The upper surface 102 of dowel 36 fits into the counterbored section 104 or 106 of the buttons 96 or 98 respectively.

Figure 8:
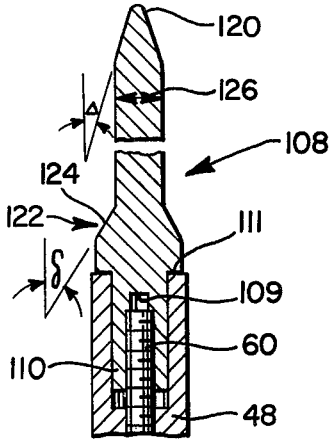

The procedure for attaching the piccolo button 108, shown in FIG. 8, is similar to that already described for the buttons 96 and 98. However, piccolo button 108 has an inner-threaded portion 110 which is threaded on upper hangerbolt section 60 of shaft 48. Since inner-threaded portion 110 is about $\frac{1}{8}$ inch longer than the upper hangerbolt section 60 a shear point 109 is created above the upper surface of the hangerbolt 60 approximately $\frac{1}{8}$ inch below the upper surface 111 of the vertical shaft 48.

The button 96 shown in FIG. 6 illustrates the general shape in cross-section of buttons of a diameter of 0.560 inch or greater and the shape of the button 98 as shown in FIG. 7 is reserved for buttons of smaller diameter. The diameter of either button 96 or 98 is varied according to the diameter of the mouth of the instrument at the point at which the instrument is contacted by the button. The height of each type of button varies also with the type of instrument. When the diameter of the mouth or bell of the instrument converges as the dowel 36 extends into the instrument the height of the button is an important factor in determining the ease of placement on or removal from the stand of the instrument. As an approximate relationship it can be said of the preferred embodiment, that as the diameter of the button triples its height doubles. Moreover, the height varies linearly from about 70% of the diameter in a button of a small diameter such as that used in the E-flat clarinet having a diameter of about 0.54 inches to 40% of the height of the button in a button of large diameter such as that used in a B-flat saprano saxophone having a diameter of about 1.6 inches.

The top edges of the buttons 96 or 98 shown in cross-section at 112 and 114 are rounded off preferably to a 3/16 inch radius. This curvature facilitates the placement on or removal from the stand of the instrument.

The lower edges shown in cross-section at 116 and 118 of the button 96 are cut at an angle beta. The extent of this angle is determined by the particular instrument involved and facilitates removal of the instrument from the stand. In buttons 98 of diameter of 0.55 inch or less, the angle tapers very slightly. However, in the larger buttons 96 the angles vary in the preferred form from 12° for oboes with a 0.56 inch diameter button to 18° for the B-flat clarinet to 23° for an English horn and 27° for a soprano saxophone with a button diameter of about 1.3 inches. As an approximate relationship it can be said that in the preferred form, the angle beta in radians is approximately $\frac{1}{3}$ of the diameter of the button in inches.

The piccolo button 108 is shown in FIG. 8. The button tip 120 is cut at an angle delta which in the preferred form is about 18°. The length of the entire button is preferably about $3\frac{1}{2}$ inches with about $2\frac{3}{4}$ inches extension above the shaft 48. The button 108 has a collar 122 upon which the piccolo rests as shown at 123 in FIG. 1. The upper instrument supporting surface 124 of the collar is cut at an angle gamma which preferably is about 35°. The button diameter 126 varies linearly from about 0.25 inches to approximately 0.45 inches for a collar diameters of 0.49 inches to 0.64 inches. That is, the button diameter varies from 45 to 70 percent of the collar diameter as button diameter increases.

The buttons 96, 98 and 108 are preferably made of a smooth hard wood such as oak. This material minimizes the abrasion of the surface of the instrument.

While this invention has been described as having a preferred design, it will be understood that it is capable of further modification. This application, is, therefore, intended to cover any variations, uses, or adaptations of the invention following the general principles thereof and including such departures from the present disclosure as comewithin known or customary practice in the art to which this invention pertains, as may be applied to the essential features hereinbefore set forth and fall within the scope of this invention or the limits of the claims.

What is claimed is:

1. A stand for supporting a wind musical instrument having inner and outer surfaces, in a substantially vertical position comprising:
(a) a base,
(b) a vertical shaft having upper and lower ends,
(c) said base being attached to said lower end of said shaft,
(d) said upper end of said shaft being adapted to fit into said instrument, and
(e) said shaft having a weakened zone which will fail if said instrument is subjected to an excessive force.

2. The stand of claim 1 and wherein:
(a) said base being a conical piece having a central hole, a top and a bottom,
(b) said lower end of said shaft fitting into said central hole in said conical piece to allow said conical to support said shaft, and
(c) said weakened zone being a central hole drilled into said lower end of said shaft.

3. The shaft of claim 2 and wherein:
(a) said shaft having a hangerbolt, said hangerbolt having upper and lower ends,
(b) said upper end of said hangerbolt being frictionally engaged by said central hole in said shaft, partially filling said hole, and
(c) said lower end of said hangerbolt extending out of the lower end of said shaft.

4. The shaft of claim 3 and wherein:
(a) said central hole in said shaft extends a distance into the lower end of said shaft such that said hole is slightly below the said top of said conical piece.

5. The stand of claim 2 and wherein:
(a) said stand having a button-shaped element,
(b) said upper end of said shaft being attached centrally to said button-shaped element, and
(c) said button-shaped element being of a diameter sufficient to provide close contact with the inner surface of said instrument when the end of said instrument is resting on said conical piece, giving said instrument sure vertical support.

6. A stand as in claim 1 and including:
(a) a second vertical shaft having upper and lower ends,
(b) a support attached to said lower end of said second vertical shaft,
(c) an instrument engaging portion attached to the upper end of said vertical shaft,
(d) said instrument engaging portion having a lower base and an upper cylindrical section,
(e) said lower base having a lower circular section and an upper section which tapers to the diameter of the upper cylindrical portion, and
(f) said upper cylindrical portion having a top which is pointed.

7. The stand of claim 6 and wherein:
(a) said top is tapered 18° from vertical.

8. The stand of claim 6 and wherein:
(a) said upper tapered portion of said lower base is tapered 35° from vertical.

9. A stand for supporting a wind musical instrument having inner and outer surfaces in a substantially vertical position comprising:
(a) a suitable base,
(b) a vertical shaft having upper and lower ends,
(c) the upper end of said shaft being attached centrally to a button-shaped element which frictionally engages the inner surface of said instrument,
(d) said button-shaped element having upper and lower edges,
(e) said upper and lower edges of said button-shaped element being tapered to facilitate placement and removal of said instrument,
(f) said button-shaped element being centrally drilled and having top and bottom countersinks,
(g) said bottom countersink receiving the upper end of said shaft,
(h) said vertical shaft having a diameter less than the diameter of said button-shaped element,
(i) said button-shaped element being removable from said shaft, and
(j) a screw for said button-shaped element having a head thereon positioned within said top countersink and threadedly connected to said shaft.

10. The stand of claim 9 and wherein:
(a) said base for said shaft being a conical piece having a central hole, a top and a bottom,
(b) said lower end of said shaft fitting into said central hole to allow said conical piece to support said shaft,
(c) said conical piece having upper and lower sections,
(d) said upper section being made of a very smooth, porous, hard material,
(e) said lower section being made of any sturdy material; and
(f) said instrument resting on a portion of said conical piece.

11. The stand of claim 10 and wherein:
(a) said stand has a mounting base,
(b) a mounting bolt extends from said conical piece,
(c) said mounting base having threaded mounting holes, and
(d) said mounting bolt mating with said mounting holes.

12. The stand of claim 9 and wherein:
(a) said lower edge of said button-shaped element is tapered in relation to the diameter of said button-shaped element in that as diameter increases said taper increases.

13. The stand of claim 12 and wherein:
(a) said button-shaped element has an angle of taper and a tapered surface,
(b) said angle of taper being measured from the vertical to the tapered surface, and
(c) said angle of taper in radians being approximately $\frac{1}{3}$ of the diameter of the button-shaped element in inches.

14. The button-shaped element of claim 12 and wherein:
(a) the height of said button-shaped element is related to its diameter in that the greater the diameter of the button-shaped element the greater its height, and
(b) the height of said button-shaped element being less than its diameter.

15. The button-shaped element of claim 14 and wherein:
(a) as the diameter of the button-shaped element triples its height doubles.

16. A stand for supporting a wind musical instrument having inner and outer surfaces in a substantially vertical position comprising:

(a) a suitable base, (b) a vertical shaft having upper and lower ends, (c) the upper end of said shaft being attached centrally to a button-shaped element which frictionally engages the inner surface of said instrument, (d) said button-shaped element having upper and lower edges, (e) said upper and lower edges of said button-shaped element being tapered to facilitate placement and removal of said instrument, (f) said vertical shaft having a diameter less than the diameter of said button-shaped element, (g) said button-shaped element being removable from said shaft, and (h) said stand has a weakened point which will shear if the stand is subjected to an excessive force.

* * * * *